US005671681A

United States Patent [19]

Senior, III

[11] Patent Number: 5,671,681

[45] Date of Patent: *Sep. 30, 1997

[54] TRANSPORTATION METHOD FOR RIDER PROPELLED VEHICLES

[76] Inventor: Milnor H. Senior, III, 3377 S. Willow Ct., Denver, Colo. 80231

[ * ] Notice: The term of this patent shall not extend beyond the expiration date of Pat. No. 5,558,023.

[21] Appl. No.: 704,886

[22] Filed: Aug. 30, 1996

Related U.S. Application Data

[63] Continuation of Ser. No. 462,134, Jun. 5, 1995, Pat. No. 5,558,023, which is a continuation of Ser. No. 174,253, Dec. 28, 1993, abandoned.

[51] Int. Cl.[6] ..... B61B 13/10

[52] U.S. Cl. ..... 104/138.1; 104/124; 104/155; 404/1

[58] Field of Search ..... 104/138.1, 124, 104/155, 126; 105/365; 406/105, 110, 111, 112; 404/1; 52/79.7

[56] References Cited

U.S. PATENT DOCUMENTS

| | | | |
|---|---|---|---|
| 1,053,368 | 2/1913 | Eells | 104/138.1 |
| 2,296,771 | 9/1942 | Crawford et al. | 104/138.1 |
| 3,090,328 | 5/1963 | Berggren | 104/23.1 |
| 3,404,638 | 10/1968 | Edwards | 104/155 |
| 3,438,337 | 4/1969 | Edwards | 104/155 |
| 3,724,691 | 4/1973 | Carstens | 104/155 |
| 3,797,405 | 3/1974 | Carstens et al. | 104/138.1 |
| 3,859,682 | 1/1975 | Sulkiewicz | 104/138.1 |
| 3,980,024 | 9/1976 | Futer | 105/365 |
| 3,999,487 | 12/1976 | Valverde | 104/155 |
| 4,023,500 | 5/1977 | Diggs | 104/138.1 |
| 4,027,596 | 6/1977 | Nardozzi, Jr. | 104/138.1 |
| 4,078,498 | 3/1978 | Futer | 105/365 |
| 4,458,602 | 7/1984 | Vandersteel | 104/138.1 |
| 4,649,588 | 3/1987 | Taylor | 14/3 |
| 4,821,647 | 4/1989 | Powell et al. | 104/138.1 |

FOREIGN PATENT DOCUMENTS

| | | | |
|---|---|---|---|
| 628897 | 11/1961 | Italy | 104/138.1 |
| 159915 | 12/1979 | Japan | 104/138.1 |

*Primary Examiner*—S. Joseph Morano
*Attorney, Agent, or Firm*—Harold A. Burdick

[57] ABSTRACT

A transportation system and method for rider propelled vehicles, such as bicycles, is disclosed, the system including a covered structure having a surface for movement thereover of the vehicle. Air is moved through the structure in a direction and at a selected velocity sufficient to aid movement of a vehicle through the structure. Relative elevations of the surface of the structure between entrance thereto and exit therefrom are selectable independently from ground grades found at the site of system installation.

19 Claims, 4 Drawing Sheets

TRANSPORTATION METHOD FOR RIDER PROPELLED VEHICLES

RELATED APPLICATION

This application is a continuation of U.S. patent application Ser. No. 08/462,134 filed Jun. 5, 1995, now U.S. Pat. No. 5,558,023 and entitled "Enclosed Transportation System for Rider Propelled Vehicles With Pneumatic Propulsion Assistance" by Milnor H. Senior, III, U.S. patent application Ser. No. 08/462,134 being a continuation of now abandoned U.S. patent application Ser. No. 08/174,253, filed Dec. 28, 1993 entitled "Transportation System and Method for Rider Propelled Vehicles" by Milnor H. Senior, III.

FIELD OF THE INVENTION

This invention relates to transportation modes, and, more particularly, relates to transportation systems and methods for rider propelled vehicles such as bicycles.

BACKGROUND OF THE INVENTION

The movement by various agencies to plan and provide for transportation systems which encourage and accommodate multiple modes of urban travel (multi-modal transportation system planning), including private motor vehicular, self-propelled (such as bicycles), pedestrian, and mass transit modes and corridors, has gained momentum in recent years. One key element of such planning is the provision of multi-nodal systems, that is, transportation systems that provide links between the various modes of movement in the system (for example, the provision of central mass transit stations linked to both major thoroughfares and at the hubs of an urban bus system).

Left out of much of this planning, however, has been consideration for linking the so called "bike-way" element of such plans into the multi-nodal system in such a way as to encourage the use of rider propelled (non-motorized) transportation as a primary mode of transportation in the system, rather than as a mere means of entertainment or recreation. In particular, such bike-ways are typically not provided in sufficient number, with sufficient separation from vehicular facilities or with sufficient links to other modes to make their use practical for commuting, as means for access to shopping facilities and the like. This has been due, in part, to the expense and/or difficulty of acquiring ways of access (easements) for bike-way construction, particularly in more congested and/or long developed urban areas, and to the costs of construction and maintenance.

Moreover, little consideration has been given to providing bike-way systems which lessen the physical impacts inherent in use of such a system, including weather related impacts and the physical exertion necessary to move over longer distances, such systems being exposed to the elements and typically following whatever terrain happens to be available for the facility.

It is apparent that for such non-motorized modes of transportation to become primary in use, and for urban areas to thus receive the benefits of reduced reliance on the private automobile, improvement of the bike-way element of multi-modal transportation systems is necessary. However, for such improvements to be adopted, the costs associated with an improved bike-way element must be reasonably related to the projected benefits, preferably adding little if any expense to current per mile aggregate acquisition, construction and maintenance costs.

SUMMARY OF THE INVENTION

This invention provides an improved transportation method for rider propelled vehicles (such as bicycles), the method being especially well adapted for urban use and for urban transportation systems, though use can as well be made of the herein disclosed methods for non-urban travel.

The bicycle transportation methods of this invention require less easement area, are adapted for use in congested urban areas, can be utilized independently from streets and highways, protect users from adverse weather conditions, and lessen the physical exertion necessary for movement of a vehicle. It is projected, that with increased use of systems employing the methods of this invention, the overall cost of the system, relative to acquisition, installation, and maintenance costs of existing types of bike-way systems and other transportation modes in an urban transportation system, will have a beneficial impact on the overall transportation budget in an urban area where it is utilized.

The methods for assisting movement of a rider propelled non-motorized vehicle (such as a bicycle) of this invention include the steps of dedicating a pathway connecting first and second selected locations to primarily provide for movement therealong of the rider propelled non-motorized vehicles and assisting riders moving along the pathway in propelling the vehicles without replacing rider directional and speed control and primary rider propulsion of the vehicles by moving air along the pathway in a direction of travel and at a selected velocity.

The pathway is preferably covered along its entire distance to shield the pathway and cyclists thereon from precipitation and to focus air flow, and is preferably segregated from other components of the transportation network. Air is moved into the covered pathway to establish a substantially constant air flow through the covered pathway, entry of the air moving into the covered pathway being controlled to stabilize air flow through the covered pathway predominantly in a direction of intended bicycle traffic movement through the covered pathway. Velocity of the air moving into the covered pathway is controlled to establish a selected air flow velocity range through the covered pathway in the direction of movement to thereby assist propulsion of a bicycle and rider in that direction without replacing normal rider operational control and propulsion of the bicycle.

First and second passageways are preferably defined at the covered pathway, air moving into each of the passageways establishing a substantially constant air flow in opposite flow directions in the first and second passageways to assist riders in propelling the vehicles in each of the passageways in the respective flow directions.

The covered pathway may be preferably elevated to provide selected pathway grade characteristics independent of the terrain grade at the site of installation.

It is therefore an object of this invention to provide an improved transportation method for rider propelled vehicles.

It is another object of this invention to provide an improved bicycle transportation method that requires less easement area to install, is adapted for use in congested urban areas, enables siting independently from streets and highways, protects users from adverse weather conditions, and lessens the physical exertion necessary for movement of a bicycle.

It is still another object of this invention to provide improved bicycle transportation methods that assist riders by providing for movement of air along a pathway to assist vehicle movement therealong without replacing rider directional and speed control and primary rider propulsion of the vehicle.

It is still another object of this invention to provide a transportation method for bicycles which includes the step of covering a bicycle pathway throughout substantially the full extent of the distance between point of departure and destination.

It is yet another object of this invention to provide a bicycle transportation method which includes the step of elevating a bicycle pathway for the purpose of controlling grade thereof independent of, and without substantial disruption of, grade of the surrounding terrain.

It is still another object of this invention to provide a method for assisting movement of a rider propelled non-motorized vehicle including the steps of dedicating a pathway connecting first and second selected locations to primarily provide for movement therealong of the rider propelled non-motorized vehicles, and assisting riders moving along the pathway in propelling the vehicles without replacing rider directional and speed control and primary rider propulsion of the vehicles by moving air along the pathway in a direction of travel and at a selected velocity.

It is yet another object of this invention to provide a method for improving a bicycle transportation component in a transportation system including the steps of establishing a pathway for bicycle transportation that extends a distance from a point of departure to a destination and is segregated from pedestrian and other vehicular transportation pathway components of the system, and covering the pathway along the entire distance to shield the pathway and cyclists thereon from precipitation.

It is another object of this invention to provide a method for establishing environments assisting riders in propulsion of bicycles that includes the steps of providing a covered bicycle pathway having characteristics selected to accommodate normal rider operational control of a bicycle when traveling through the covered pathway, moving air into the covered pathway to establish a substantially constant air flow through the covered pathway, controlling entry of the air moving into the covered pathway to stabilize air flow through the covered pathway predominantly in a direction of intended bicycle traffic movement through the covered pathway, and controlling velocity of the air moving into the covered pathway to establish a selected air flow velocity range through the covered pathway in the direction of movement to thereby assist propulsion of a bicycle and rider in the direction of movement without replacing normal rider operational control and propulsion of the bicycle.

It is yet another object of this invention to provide a method for establishing environments assisting riders in propulsion of bicycles that includes the steps of defining first and second passageways at a covered pathway, and moving air into each of the passageways to establish a substantially constant air flow in opposite flow directions in the first and second passageways to assist riders in propelling the vehicles in each of the passageways in the respective flow directions.

With these and other objects in view, which will become apparent to one skilled in the art as the description proceeds, this invention resides in the novel system, construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
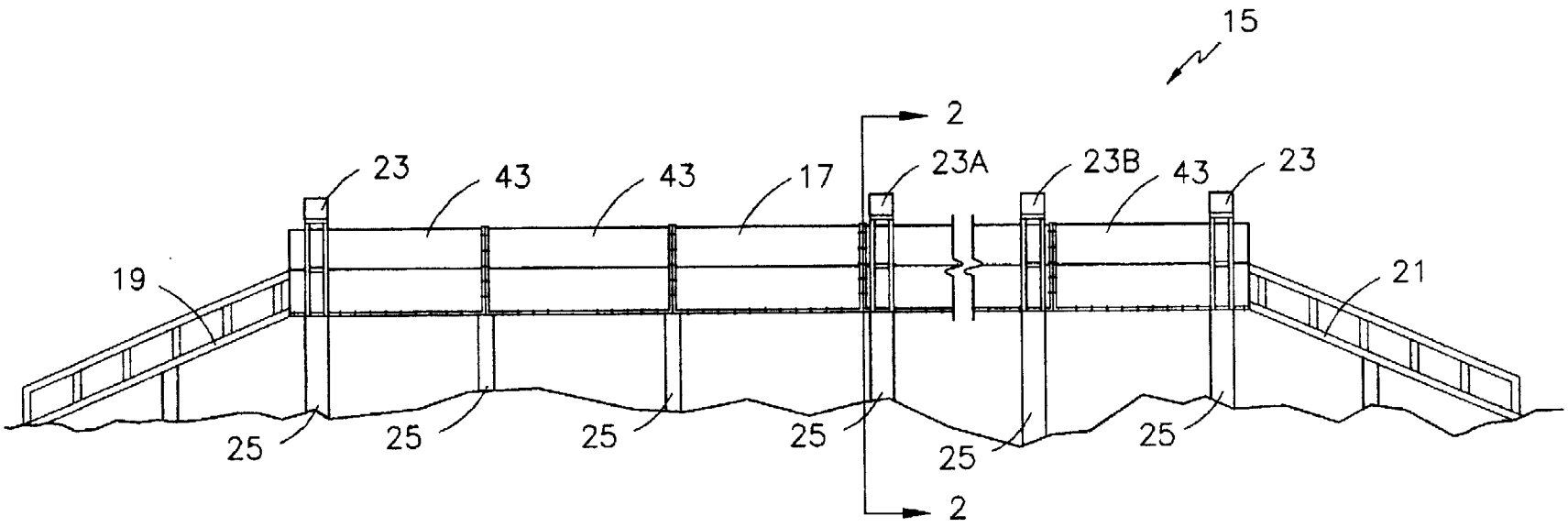
FIG. 1 is a side view illustrating diagrammatically the system of this invention.

FIG. 1 is an illustration of the transportation system 15 of this invention erected on a site having varied terrain (the system of this invention as illustrated in FIG. 1 is, like any bike-way system, intended to cover substantial distances, certainly in excess of 1000 meters in any given segment, and is elevated for grade control and for siting considerations, as more fully discussed hereinafter, and not merely an overpass structure for example). While the system of FIG. 1 is shown to be elevated, elevation is but one of the improvements discussed herein and need not be utilized in every application.

System 15 includes passage structure, or tunnel, 17 providing a pathway for rider propelled vehicles, such as bicycles. Access ways 19 and 21 provide rider entry into and egress from structure 17. Air movers, or fan units (preferably vane axial blower fans), 23 are beneficially provided to create air flow in the direction of vehicle movement (one or two way movement) through structure 17, the air flow being of a velocity sufficient to aid movement of the vehicle. While top-mounting of the fan units is shown, the fan units could be mounted at grade with appropriate ducting and allowance for duct system losses.

Risers 25 (made of concrete, steel, wood or composite material supporting piers) support structure 17 and are of lengths selected so that the grade of the structure can be controlled without changing grade of the terrain at the site of installation. While a multi-legged riser unit 25 is shown, a pedestal type riser could also be utilized where right-of-way acquisition is even more severely limited.

Figure 2:
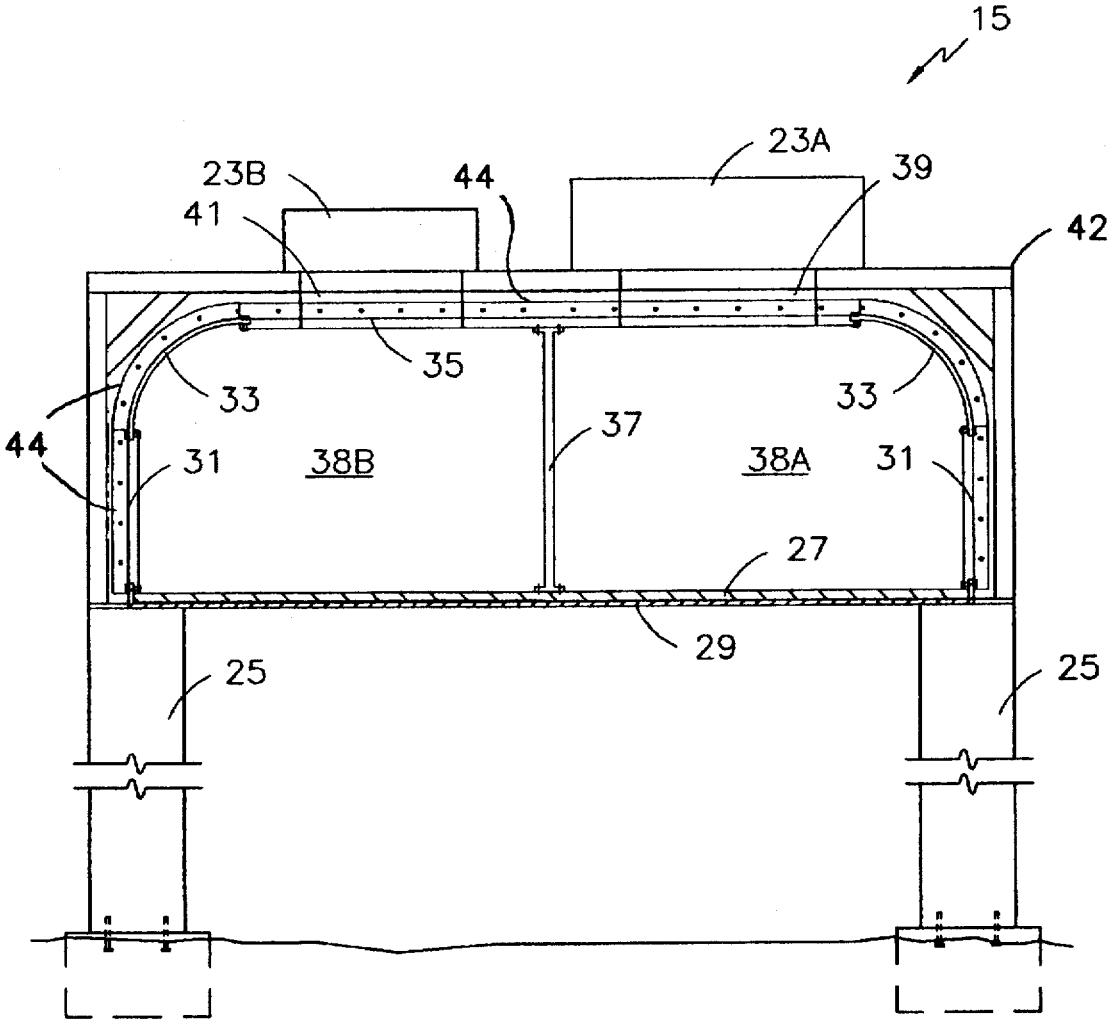
FIG. 2 is a sectional view taken through section lines 2—2 of FIG. 1.

As shown in FIG. 2, structure 17 includes vehicle support surface 27 (poured tartan, concrete, asphalt, or the like) maintained in foundation element 29 attached to side walls 31. Light transmitting wall panels 33 (transparent or translucent) are supported on walls 31 and in cover structure 35. It should be appreciated that a single unitary (for example, molded or extruded) wall could be provided in place of the multi-unit structure formed by walls 31, 33 and 35. Tunnel divider wall 37 (preferably selectively positionable, from left to right in the FIGURE) is maintained between cover structure 35 and surface 27 in the structure to divide structure 17 into discrete passageways 38A and 38B (though any number of passageways and/or lanes could be provided). The overall width of support surface 27 is selected depending on desired lane capacity as well as siting of the structure (for example, the overall structure could be wide enough to allow erection of the system over existing street right-or-ways thereby implicating no land acquisition to site the structure).

Fan units 23A and 23B are provided with ducting 39 and 41, respectively, for supply and return air functions within each passageway to provide air flow in a direction corresponding to the intended direction of travel of vehicles through each passageway (i.e., in opposite directions). The fan units are appropriately supported on support structure 42 (for example, an ironwork frame support) which in turn are mounted on risers 25.

Walls 31, 33, 37 and cover structure 35 may be constructed from common building materials such as structural steel shapes, concrete, and plastic such as Plexiglass, Lexan, or various types of recycled rigid plastic building materials (molded, blown, or heat deformation techniques may be utilized), with structure 17 preferably being assembled of discrete, transportable tunnel modules (43 in FIG. 1) fabricated off-site. For this purpose, each of wall segments 31 and 33 and cover structure 35 include flanges 44 at their opposite ends (both ends) to facilitate interconnection of the modules, with the interconnections being appropriately sealed to preserve air flow. The interior of structure 17 should be aerodynamically smooth and, for purposes of the following disclosure, the smoothness of the surface is assumed to be approximately the same as commercial metal ductwork.

To properly provide for the desired air flow velocity in the passageways (between about 10 and forty miles per hour, and preferably about 30 miles per hour) proper fan capacity for fan units 23 must be determined. This is done by first determining the equivalent diameter of a circular duct by calculating the actual cross sectional area of half of structure 17 (i.e., of passageway 38A or 38B). The resulting area is then used in the formula for the area of a circle. The formula is then solved for radius and the equivalent diameter of a circular duct is thus twice the radius (the equivalent diameter referred to is for one half of the area of the interior of structure 17).

Fan capacity calculations must be corrected for the actual density of air at the installation site. For example, standard density of air at sea level is 0.075 lbm./ft. while the density of air at one mile above sea level is about 0.062 lbm./ft. Also necessary for the air calculations is velocity pressure (VP), the pressure exerted by flowing air due to the velocity. The units for velocity pressure are inches of water gage (in. w.g.).

The airflow required to produce a desired velocity in one passageway is calculated from the standard air formula, quantity (in ft.$^3$/min.)=area (in ft.$^2$)×velocity (in ft./min.).

Also needed for calculations of necessary fan capacity for a given installation is the friction in the passageway (i.e., the resistance to air flow that must be overcome by the pressure produced by the fans). The friction loss ($H_f$) is measured empirically as follows:

$$H_f=0.0307\times(\text{velocity (ft./min.)})^{0.533}/(\text{quantity(ft.}^3\text{/min.)})^{0.612}$$

This empirical formula is based on standard air of 0.075 lb./ft.$^3$ density flowing through clean, round, galvanized ducts with an equivalent sand grain roughness of 0.0005 ft.$^{(2)}$.

All smooth surfaces have peaks and valleys. The mean distance between these high and low points is the absolute roughness $\epsilon$. The relative roughness $\epsilon/D$ of the surface in a conduit is the absolute roughness divided by the effective diameter. Because of the small value for $\epsilon$ (0.000005 ft. for very smooth surfaces to 0.01 ft. for very rough surfaces) and the very large value for D, the relative roughness of the tunnel will be low. Smoother materials are preferred and will lower the aerodynamic resistance resulting in lower energy usage and operating cost.

The interior of structure 17 should employ as many curved walls as possible since round ducts are more effective for flowing air as compared to irregular cross sections.

Tunnel length for 1" w.g. pressure drop is used in determining the spacing of fan units 23. This value represents the length of structure 17 (with a friction loss of $H_f$) that will cause a pressure drop in the air of 1" w.g. It is calculated by:

$$\text{Tunnel length (ft.)}=1/(H_f\times VP)$$

Figure 5:
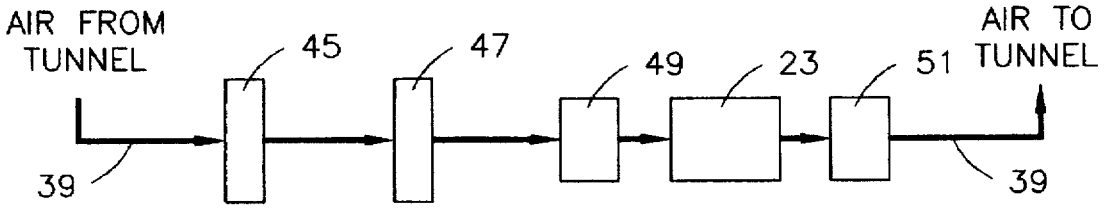
FIG. 5 is a block diagram of air handling systems utilized in this invention.

Since it may be desirable to provide air filtration, heating and/or cooling, estimates of the pressure losses associated with ducting 39/41 to remove the air from the tunnel, filter the air, heat or cool the air, and return the air to the tunnel must be accounted for. Assuming, for example, a design velocity for air in the ducts of 3,500 ft./min. (a normal velocity for this application), the design pressure drop through filter 45 (FIG. 5) would be about 0.50 in. w.g. As debris collects on the filter media, the pressure drop through the filter will increase. However, automatic filters are available that advance new media into the air stream when the pressure drop exceeds a set point, resulting in a reasonably constant pressure drop.

The design pressure drop through the heating and cooling equipment 47 would be about 2.00 in. w.g. This is a reasonable value and is obtained by using equipment with large cross sectional areas to minimize the pressure drop. Equipment with smaller cross sectional areas would cost less initially but would have higher pressure drops resulting in higher pressures required from the fans and thus higher operating cost.

An additional 2.00 in. w.g. of pressure drop approximately should also be foreseen for losses that will occur because of the ducts and elbows necessary to remove the air from the tunnel and return it to the passageways of structure 17.

Optional fan inlet and fan discharge silencers 49 and 51 are provided to offset noise created by high horsepower vane axial fans. Specific selection of industrial grade silencers can be made after noise data for the selected fans are obtained. All major fan manufacturers provide the necessary noise data for selection of appropriate silencers.

Figure 3:
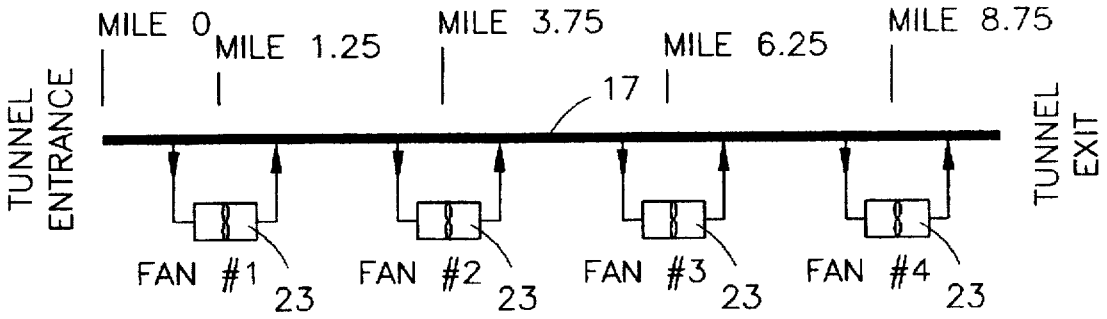
FIG. 3 is a block diagram showing spacing of air movers advantageously used in the system.

The velocity pressure of the air in the system shown in FIG. 3 is added to the static losses to obtain total pressure (total pressure=static pressure+velocity pressure.) Total pressure is required for sizing the fan units 23.

Figure 4:
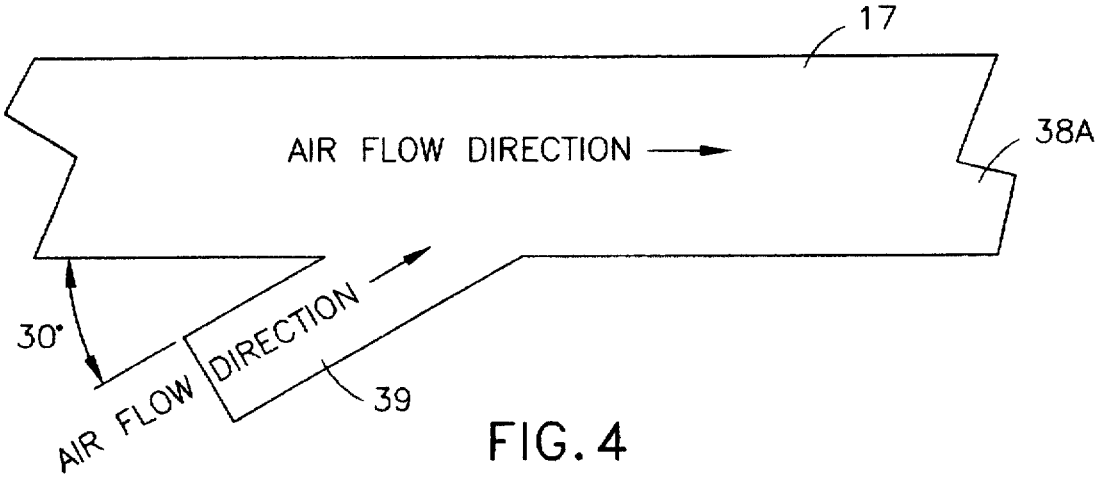
FIG. 4 is a diagram illustrating branch angles for air inlet.

Turning to FIG. 4, each fan unit 23 has two duct connections to a passageway of passage structure 17, one for supply air to the fan and one for return air to the passageway. FIG. 4 shows a typical branch connection for a duct returning air from a fan to the passageway. The connection for a duct supplying air to a fan from the passageway would appear the same except for the directions of the air flow. Both supply and return connections should be covered with heavy wire mesh to protect riders.

The branch connection from the fan to the passageway could be made into the vertical side walls 31 of the structure 17 or cover structure 35. The section of structure 17 where the connection is made would need to be constructed from a more durable material and/or reinforced or supported. Branch connections should preferably have a minimum angle between the passageway and branch duct (about 30° is practical). This will help to minimize pressure drop and to maintain air flow inside the passageway in the desired direction.

Duct sizing necessary for the design velocity is calculated by:

$$\text{area (ft.}^2\text{)=air quantity (ft./min.)/air velocity (ft./min.)}$$

Since the branch duct from (or to) the fan units connects with structure 17 at an angle, the area of the opening in the walls will be larger than the cross-sectional area of the duct. This area is calculated by:

area in tunnel wall (ft.$^2$)=area in duct (ft.$^2$)/cos(entry angle)

The width of the opening in the tunnel wall is calculated by:

width (ft.$^2$)=area (ft.$^2$)/tunnel wall height (ft.)

Figure 7:
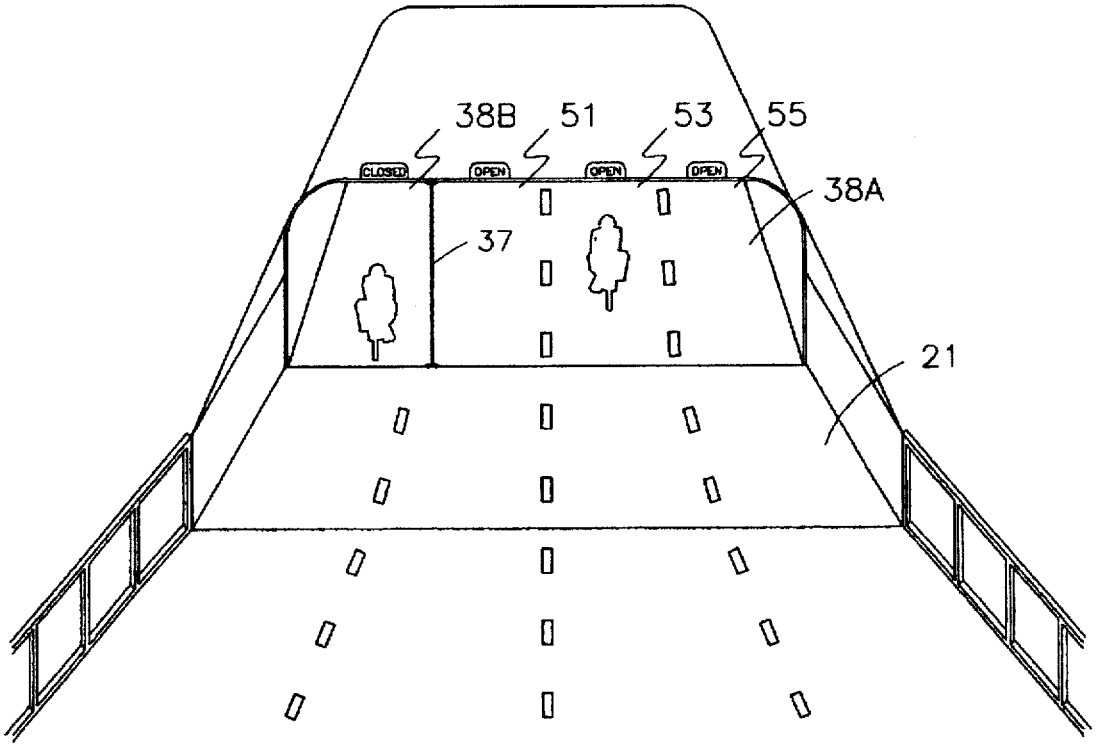
FIG. 7 in a diagrammatic illustration of a larger multi-lane system in accord with this invention.

In this section of the disclosure, the requirements for fan units 23 for one lane in a passageway (as shown in FIG. 7 multiple lanes may be provided in a single passageway 38A or 38B) are developed. One fan system per lane is beneficial because of the size availability of standard industrial vane axial fans. While larger sizes are available, they involve a higher amount of custom design and engineering by the suppliers. It is felt that larger numbers of smaller fans will allow single fans to be taken out of the system for maintenance or repair without major impact on the overall system operation.

Once the air quantity requirements for fan units 23 are obtained from the calculations set forth hereinabove, the performance characteristics for a single fan unit 23 (the maximum air pressure that the fan can develop) is determined. The system loss pressure is subtracted from the maximum pressure and the resulting pressure is the amount that is available to overcome the friction loss in the tunnel (tunnel losses (in. w.g.)=maximum pressure-system losses).

The equivalent length of tunnel that will use the available pressure is calculated by:

length (ft.)=available pressure (in. w.g.)×length for 1" drop (ft./1 in. w.g.)

The fan efficiency is read from the fan performance chart. The fan brake horsepower is calculated by:

fan power (bhp)=density correction×quantity×static pressure/(efficiency×6,356)

By way of example, for a ten mile system 15 shown in FIG. 3 and installed in Denver, Colo. (approximately one mile above sea level), having a structure 17 width of 25 feet, wall height of 10 feet to a cover structure peak of 13 feet (full cross-sectional area of 325 square feet), and which is designed for an air velocity in a passageway of 30 miles per hour (2,640 feet per minute) where normal wall friction losses are expected (a friction factor of 0.000730785 VP per foot of tunnel length, and tunnel length for 1" w.g. drop of 3,787 ft.), a duct design velocity of 3,500 ft./min. with fan units 23 having a 214,500 ACFM capacity and spaced at 2.5 mile intervals would be required for a single passageway lane (this assumes air handling system losses of about 4.5 in. w.g.). An initial fan unit 23 at each tunnel entrance (as shown in FIG. 1) or branch connection (as shown in FIG. 6) of similar capacity, while not shown in FIG. 3, is required in most applications.

It would be preferable to interpose between ducts 39/41 and fan units 23 vibration isolation joints to minimize vibration translation from the fans to structure 17. Further, where fans are mounted above the structure 17, extensive effort should be made to further isolate vibration (for example, by mounting units 23 on a separate platform above structure 17). For side entry, fan units 23 could be mounted at grade on appropriate pads.

For fan units 23 dedicated to additional lanes of a passageway (where plural lanes are used as shown in FIG. 7 for passageway 38A having lanes 51, 53 and 55), such units should be spaced equally over the distance to be covered by the lane and between the fan units of an adjacent lane (i.e., so that fan units of adjacent lanes are staggered over the distance to be covered by structure 17). This will provide even distribution of air velocity along the entire length of the multi-lane passageway, avoiding "dead spots" of reduced air velocity in areas between fan inlets and discharges. Even spacing of fans along the entire length of structure 17 helps to maintain a substantially constant overall air pressure along the entire length of the passageway.

Figure 6:
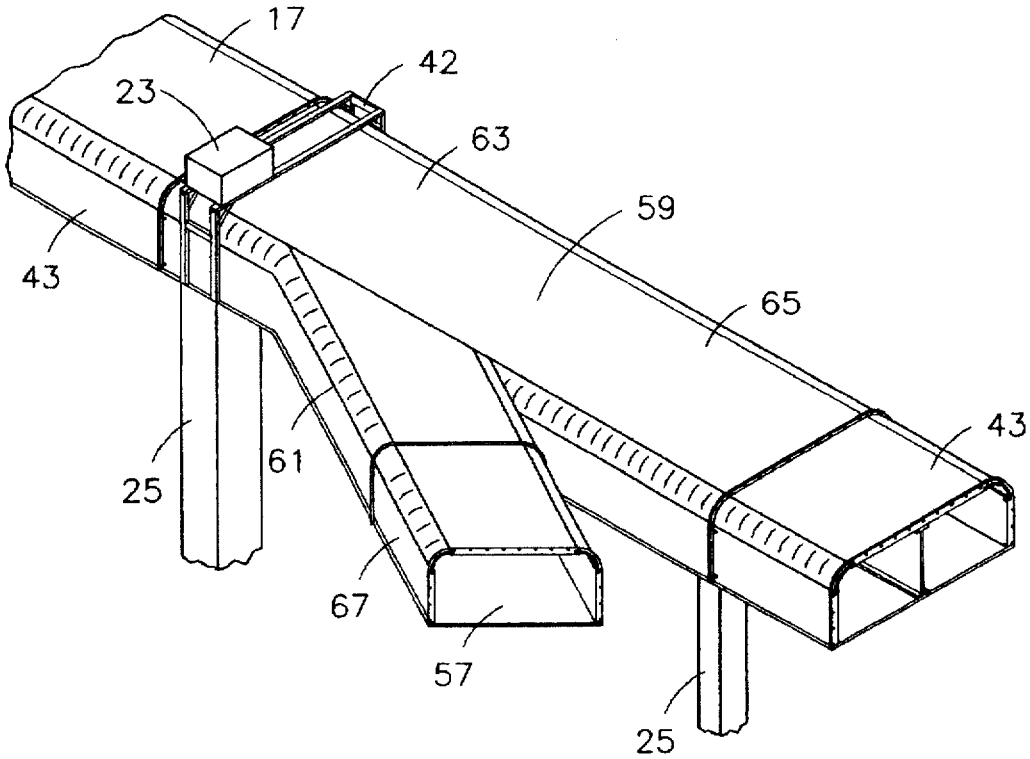
FIG. 6 is an illustration of a medial entrance to or exit from the system.

Turning to FIG. 6, an intermediate access way 57 (an intermediate entryway is shown, though ways of intermediate egress may also be provided) to structure 17 enters at the smallest safe angle possible (to minimize pressure drop at the opening) into a passageway of structure 17. For such intermediate access ways, it is preferable to minimize exit and entrance size (small as possible), maximize friction in the entrances and exits (i.e., to provide a high resistance to air flow into the intermediate access ways, for example by choice of intermediate access way wall materials and/or curvatures and/or angles of entrance and exits). In addition a high pressure wind curtain system could be utilized to minimize loss of system air. Since some loss of air at the site of such intermediate access ways is to be expected, an additional fan unit 23 may be required immediately adjacent to the entry or exit point.

As shown in FIG. 6, for a modular system, a special intermediate module 59 is provided having access way angle entry portion 61, and tunnel portions 63 and 65 (a y-branch type of structure). Module segments 43 and ramp modules 67 are connected to provide the desired structure at the site of installation.

As may be appreciated from the foregoing, improved transportation methods are provided for rider propelled vehicles, the methods being calculated to encourage use of such vehicles as a primary mode of transportation.

What is claimed is:

1. A method for assisting movement of a rider propelled non-motorized vehicle comprising:

dedicating a pathway connecting first and second selected locations to primarily provide for movement therealong of rider propelled non-motorized vehicles; and assisting riders moving along said pathway in propelling the vehicles without replacing rider directional and speed control and primary rider propulsion of the vehicles by moving air along said pathway in a direction of travel and at a selected velocity.

2. The method of claim 1 further comprising the step of maintaining a substantially constant overall air pressure along said pathway between said first and said second selected locations.

3. The method of claim 1 further comprising at least one of filtering, heating, and cooling said air moving along said pathway.

4. The method of claim 1 further comprising controlling grade of said pathway without substantial alteration of surrounding terrain grade.

5. The method of claim 1 further comprising substantially enclosing said pathway between said locations.

6. The method of claim 5 further comprising the steps of providing a structure establishing said pathway and an enclosure of said pathway, and segregating said structure from pedestrian and other vehicular transportation pathways.

7. The method of claim 1 further comprising defining first and second passageways at said pathway, and moving air in substantially opposite flow directions in said first and second passageways to assist riders in propelling the vehicles in each said passageway in the respective flow direction.

8. A method for improving a bicycle transportation component in a transportation system comprising the steps of:

establishing a pathway for bicycle transportation that extends a distance from a point of departure to a destination and is segregated from pedestrian and other vehicular transportation pathway components of the system;

covering said pathway along the entire said distance to shield said pathway and cyclists thereon from precipitation; and moving air adjacent to said pathway in a direction and at a velocity sufficient to assist movement of cyclists over said pathway.

9. The method of claim 8 further comprising the step of elevating said covered pathway along substantially the entire said distance for selectively establishing grade characteristics of said pathway independently from adjacent terrain grades.

10. The method of claim 9 wherein said selected grade characteristics are lack of grade along most of said distance.

11. The method of claim 8 wherein the step of covering said pathway includes configuring covering structure to also shield cyclists on said pathway from naturally occurring wind conditions.

12. A method for establishing environments assisting riders in propulsion of bicycles comprising:

providing a covered bicycle pathway having characteristics selected to accommodate normal rider operational control of a bicycle when traveling through said covered pathway;

moving air into said covered pathway to establish a substantially constant air flow through said covered pathway;

controlling entry of said air moving into said covered pathway to stabilize air flow through said covered pathway predominantly in a direction of intended bicycle traffic movement through said covered pathway; and controlling velocity of said air moving into said covered pathway to establish a selected air flow velocity range through said covered pathway in said direction to thereby assist propulsion of a bicycle and rider in said direction without replacing normal rider operational control and propulsion of the bicycle.

13. The method of claim 12 further comprising defining first and second passageways at said covered pathway, and moving air into each of said passageways to establish a substantially constant air flow in opposite flow directions in said first and second passageways to assist riders in propelling the vehicles in each said passageway in the respective flow direction.

14. The method of claim 13 further comprising defining multiple bicycle lanes in at least one of said passageways.

15. The method of claim 12 wherein said air flow velocity range is between about 10 and 40 miles per hour through said covered pathway.

16. The method of claim 12 wherein the step of moving air into said covered pathway includes moving air into said covered pathway from multiple locations located along said covered pathway.

17. The method of claim 12 further comprising the steps of providing intermediate entrances to or exits from said covered pathway and controlling air flow direction and velocity thereat to minimize air flow disruption downstream thereof.

18. The method of claim 12 wherein the step of providing a covered bicycle pathway includes the steps of fabricating pathway covering modules, transporting said modules to a pathway site, and joining said modules end to end to form said covered pathway.

19. The method of claim 12 wherein the step of providing a covered pathway includes the step of utilizing pathway covering material that admits ambient light into the covered pathway.

* * * * *